US009103636B1

(12) United States Patent
Ames et al.

(10) Patent No.: US 9,103,636 B1
(45) Date of Patent: Aug. 11, 2015

(54) PENETRATING WARHEAD AND METHOD

(71) Applicant: RAYTHEON COMPANY, Waltham, MA (US)

(72) Inventors: Richard Ames, Tucson, AZ (US); Craig L Wittman, Tuscon, AZ (US)

(73) Assignee: Raytheon Company, Waltham, MA (US)

( * ) Notice: Subject to any disclaimer, the term of this patent is extended or adjusted under 35 U.S.C. 154(b) by 125 days.

(21) Appl. No.: 13/690,210

(22) Filed: Nov. 30, 2012

(51) Int. Cl.
*F42B 10/00* (2006.01)
*F42B 12/10* (2006.01)
*F42B 1/02* (2006.01)

(52) U.S. Cl.
CPC .. *F42B 12/10* (2013.01); *F42B 1/02* (2013.01)

(58) Field of Classification Search
CPC .. A21B 43/117; A21B 29/02; A21B 43/1185; A21B 43/116; A21B 43/119; A21B 7/007; A21B 43/263; A21B 43/118; A21B 49/04; A21B 49/10; A21B 29/12; A21B 17/042; A21B 23/01; A21B 23/14; A21B 25/00; A21B 29/08; A21B 29/10
USPC ..... 102/306–310, 476
See application file for complete search history.

(56) References Cited

U.S. PATENT DOCUMENTS

| | | | | | |
|---|---|---|---|---|---|
| 2,667,836 | A * | 2/1954 | Church et al. | ..... | 175/4.53 |
| 2,935,020 | A * | 5/1960 | Howard et al. | ..... | 102/307 |
| 3,014,424 | A * | 12/1961 | Delacour | ..... | 102/310 |
| 3,066,736 | A * | 12/1962 | Venghiattis | ..... | 175/4.52 |
| 3,490,372 | A * | 1/1970 | Lavine | ..... | 102/309 |
| 3,906,857 | A * | 9/1975 | Rotondi, Jr. | ..... | 102/428 |
| 3,968,748 | A * | 7/1976 | Burford et al. | ..... | 102/394 |
| 4,106,411 | A * | 8/1978 | Borcher et al. | ..... | 102/495 |
| 4,160,412 | A * | 7/1979 | Snyer et al. | ..... | 102/307 |
| 4,391,337 | A * | 7/1983 | Ford et al. | ..... | 175/4.6 |
| 4,753,170 | A * | 6/1988 | Regalbuto et al. | ..... | 102/305 |
| 4,768,440 | A * | 9/1988 | Deneuville et al. | ..... | 102/495 |
| 5,198,615 | A * | 3/1993 | Robbie et al. | ..... | 102/476 |
| 5,355,802 | A * | 10/1994 | Petitjean | ..... | 102/313 |
| 5,621,185 | A * | 4/1997 | Spengler et al. | ..... | 102/476 |
| 5,698,814 | A * | 12/1997 | Parsons et al. | ..... | 102/478 |
| 7,418,905 | B2 * | 9/2008 | Bootes et al. | ..... | 102/476 |
| 2004/0011238 | A1 * | 1/2004 | Ronn et al. | ..... | 102/492 |

* cited by examiner

*Primary Examiner* — Samir Abdosh
(74) *Attorney, Agent, or Firm* — Renner, Otto, Boisselle & Sklar, LLP

(57) ABSTRACT

An explosive device includes a housing and an explosive charge within the housing. The explosive charge includes a primary explosive charge and a shaped charge placed against an inside surface of the housing. The explosive device may further include a buffering material that separates the shaped charge and the primary explosive charge. The shaped charge provides a means for opening the housing before detonating the primary explosive charge, thereby enhancing the blast effect from detonating the primary explosive charge.

6 Claims, 2 Drawing Sheets

PENETRATING WARHEAD AND METHOD

FIELD OF THE INVENTION

The present invention relates generally to warheads, and more particularly, to a penetrating warhead and method.

BACKGROUND

A warhead is that part of a bomb, missile, projectile, torpedo, or other munition with an explosive charge. Warheads require casings to provide strength, fragmentation, and other properties. Penetrating warheads, sometimes referred to as "bunker busters," are designed to penetrate a protective barrier to reach targets shielded by the protective barrier. The protective barrier can include earth, rock, sand, water, man-made structures, and combinations thereof, for example. An exemplary target is an underground bunker room, for example—a reinforced man-made structure protected by layers of earth and/or rock.

A penetrating warhead typically has a stronger casing to enable the warhead to punch through the protective barrier to reach the target. The explosive within the warhead must survive the impact and delay detonating until it reaches a desired location to damage or destroy the target. When an explosive charge within a sealed casing is detonated, the casing absorbs some of the explosive energy in expanding and fragmenting the casing.

SUMMARY OF THE INVENTION

While a strong or thick casing is required to deliver an explosive charge through a protective barrier to a target, such a casing also inhibits the most effective transfer of energy from the explosive charge toward the target. The present invention provides a penetrating warhead with means for opening the casing, effectively "unzipping" the case, reducing its structural integrity, before the explosive charge is detonated. Opening the casing prior to detonation reduces the energy lost to work on the case and fragment kinetic energy and increases the blast energy that escapes the casing. This leads to a more efficient warhead with a higher yield for an equivalent explosive charge. By opening up the casing prior to detonation of the explosive charge, less energy is absorbed by the casing and more energy is available to damage or destroy the target. Specifically, plastic deformation of the casing and casing fragment energy is significantly reduced and blast pressures are significantly increased.

More particularly, the present invention provides an explosive device that includes a housing and an explosive charge within the housing. The explosive charge includes a primary explosive charge and a shaped charge placed against an inside surface of the housing. The explosive device may further include a buffering material that separates the shaped charge and the primary explosive charge.

The present invention further provides a method that includes the following steps: (1) providing a penetrating warhead having a primary explosive charge within a casing and a shaped explosive charge adjacent an inside surface of the casing, (2) detonating the shaped explosive charge to fracture the casing adjacent the shaped explosive charge, and (3) detonating the primary explosive charge. The method may further include the step of detonating the primary explosive charge, which occurs after the step of detonating the shaped explosive charge.

Alternatively, the present invention can be characterized as providing a penetrating warhead having a volume containing an explosive charge, means for protecting the explosive charge, means for at least partially withdrawing the protecting means, and means for initiating the withdrawing means and detonating the explosive charge.

The warhead can further include means for separating the withdrawing means and the explosive charge. An exemplary separating means includes a bufferent material. The protecting means can include a casing having sufficient strength to withstand impact, the explosive charge being contained within the casing; and the withdrawing means includes a shaped explosive charge adjacent an inner surface of the casing to rupture the casing before the explosive charge is detonated.

The concept provided by the present invention can be integrated into existing warheads. No special casing is required.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

Previous work on increasing blast effects has focused on increasing the blast-producing energy in the explosive charge. Toward this end, attempts have been made to develop new formulations for the primary explosive charge, to provide liner materials that react in the detonation, or to pursue alternative technologies, such as fuel-air explosives. In contrast, the penetrating weapon provided by the invention does not change the energy in the explosive charge, but instead reduces the amount of energy lost to other phenomena, thereby providing a net energy gain for the blast wave.

This approach is particularly beneficial for penetrating warheads. Penetrating increasingly strong and thick protective barriers, often discussed in terms of penetration depth, generally requires a relatively large mass per unit cross-sectional area, which typically means relatively thick casings. This increase in casing thickness is necessary to provide sufficient structural integrity to deliver the primary explosive charge through the protective barrier to the target. The increased casing thickness reduces the effectiveness of the blast effects, however, because the thickness of the casing means that detonation of the primary explosive charge in a closed casing leads to extensive plastic work of the casing that occurs in the expansion/fracture process following detonation. Trying to recover that energy loss with higher-energy explosive materials is likely less effective than reducing the energy lost to the casing.

The present invention provides a penetrating warhead with means for opening its casing before a primary explosive charge within the casing is detonated. This increases the energy of the detonated explosive charge that escapes the casing. Accordingly, the present invention provides a more efficient penetrating warhead, one with a higher yield for an equivalent explosive charge. Less of the energy provided by the explosive charge is absorbed by the casing and more energy is available to damage or destroy the target.

Figure 1:
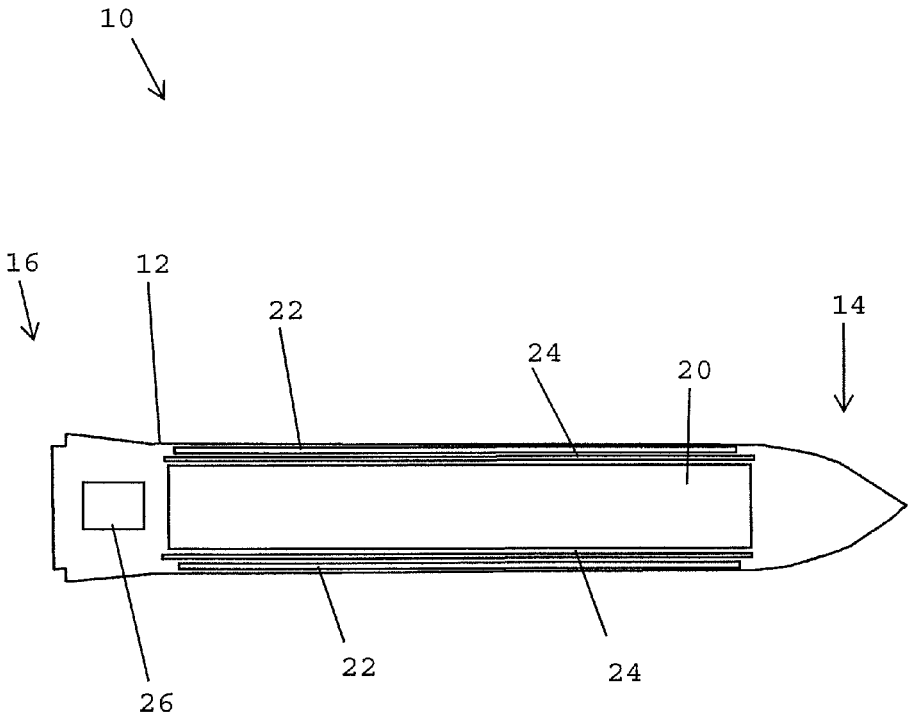
FIG. 1 is a schematic illustration of a longitudinal cross-section of a penetrating warhead provided in accordance with the invention.

An exemplary penetrating warhead 10 is shown in FIG. 1. The warhead 10 includes a casing 12, which also may be referred to as a housing or case. The casing 12 has a forward end 14 designed to withstand impact with a protective barrier, and a rear or aft end 16 longitudinally opposite the forward end. A rocket motor, control fins, and any electronic components, such as a controller and a detonator, typically would be found toward the aft end 16 of the penetrating warhead 10.

The penetrating warhead 10 further includes a primary explosive charge 20 within the casing 12. In other words, the casing 12 defines a chamber or volume within which the primary explosive charge 20 is contained. The primary explosive charge 20 generally occupies as much of the free volume that is available inside the casing 12.

Adjacent a side, and particularly an inside surface of the casing 12, the warhead 10 has one or more shaped explosive charges 22. The shaped explosive charges 22 are positioned adjacent an inner surface of the casing 12 to rupture the casing 12 or split it open, preferably avoiding using energy for plastically deforming the casing 12. A shaped charge 12 is an explosive charge that is designed to direct its explosive energy in a particular direction, in this case outward, toward the casing 12. An exemplary shaped charge 22 includes multiple linear shaped charges 22 spaced around the inner circumference of the casing that extend longitudinally from the forward end 14 of the casing 12 toward the aft end 16 of the casing 12.

In the illustrated embodiment, a buffer material 24 between the shaped charge 22 and the primary explosive charge 20 prevents or minimizes deflagration or detonation of the primary explosive charge 20 upon detonation of the shaped charges 22.

During a deflagration, an explosive charge burns quickly and at a high temperature, which consumes the explosive charge without generating a significant shockwave. The line between deflagration and detonation is imprecise, however. In general, deflagrations are thermal reactions that occur at speeds depending largely on the chemistry of the explosive charge. These speeds typically are less than the speed of sound in the explosive material, building pressure, particularly in confined spaces like the casing, and high temperatures as the explosive charge is consumed. In a detonation, however, the reaction speeds typically are higher than the speed of sound in the explosive material and thus create a shockwave that accelerates the propagating explosive reaction and produces higher temperatures and pressures than a deflagration.

Some materials and some situations of temperature and confinement can transition from deflagration to detonation, and the buffer material 24 provided between the primary explosive charge 20 and the shaped charge 22 is intended to prevent the deflagration of the explosive charge 20. The buffer material 24 also can help to direct the energy generated by the shaped charge 22 away from the primary explosive charge 20 and toward the casing 12.

The warhead 10 further includes an igniter (not shown), which also may be referred to as a detonator, an initiator or a booster, for initiating an explosion of the primary explosive charge, the shaped charge, or both. The warhead 10 also may include a controller 26 that controls the igniters in the warhead 10.

Figure 2:
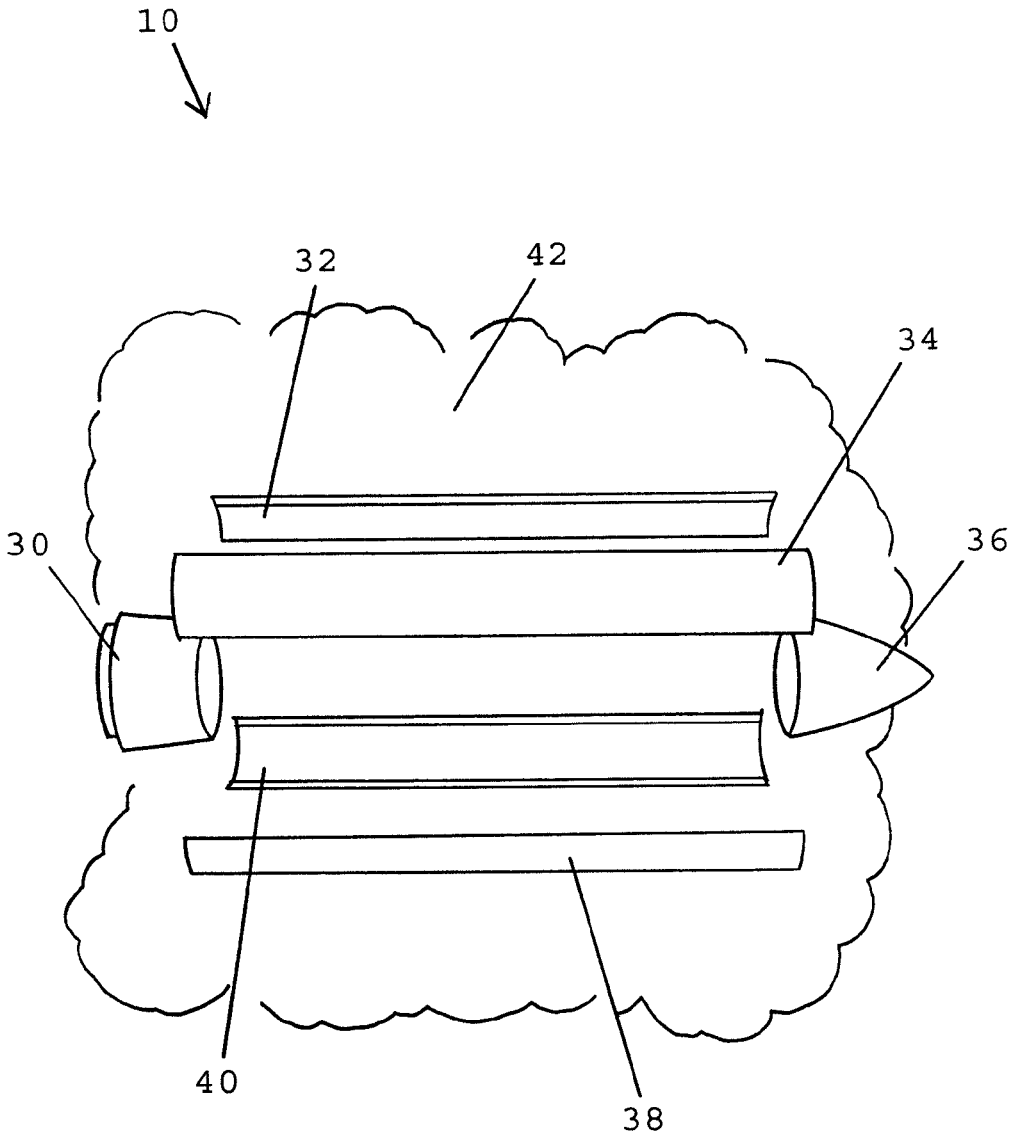
FIG. 2 is a perspective illustration of an exemplary casing for the warhead of FIG. 1, shown broken apart at detonation of the primary explosive charge.

Referring now to both drawing figures, the effect of detonating the warhead 10 is shown in FIG. 2. The shaped charges 22 typically are detonated before the main or primary explosive charge 20 to split the case 12 into sections 30, 32, 34, 36, 38, and 40. The gases 42 and blast waves generated in the detonation of the primary explosive charge 20 may push the sections 30, 32, 34, 36, 38, and 40 outward, as shown, but much less energy is consumed in doing so than otherwise would have if the shaped charges 22 had not split the casing 12 apart. While this may require the use of the buffer material 24 to prevent detonation transfer from the shaped charges 22 to the main explosive charge 20, it may be possible to initiate detonation of both the shaped charge 24 and the primary explosive charge 20 at the same time if the primary explosive charge 20 is of a type which has a low detonation speed, so that the shaped charge detonation progresses more quickly than the detonation of the primary explosive charge 20.

The warhead 10 provided by the invention can be incorporated almost any weapon that uses an explosive-filled warhead, although at present the most advantage appears to be in larger explosive weapon classes. The warhead can be provided in the form of a missile, torpedo, rocket, projectile, or other munitions which contains an explosive charge.

In contrast to other types of warheads, the penetrating warhead 10 provided by the invention is not concerned with generating high velocity projectiles from fragments of the casing 12. Rather, the penetrating warhead 10 preferably maximizes the pressure wave generated from the detonation of the primary explosive charge 20, and the warhead 10 provided by the present invention seeks to avoid requiring the explosive charge 20 energy to plastically work the casing 12, splitting it open in advance of the detonation. The following table compares an estimated improvement in a warhead provided by the present invention as compared to a conventional warhead that emphasizes fragmentation effects.

TABLE 1

Expected Blast Energy Improvement

| | Standard Detonation | Case-splitting detonation |
|---|---|---|
| Blast Equivalence (% of Charge Mass) | 40% - 60% | 80% - 90% |
| Blast Energy Improvement | 0x | 1.33x - 2.25x |

As can be seen, our models predict an increase in blast energy escaping the ruptured casing that is approximately 1.33 to 2.25 times the blast energy escaping a standard fragmenting detonation. A greater percentage of the primary explosive charge 20 is consumed in fragmenting the casing 12 and imparting kinetic energy to the fragmentation components.

While the warhead 10 provided by the invention was initially conceived in the context of penetrating protective barriers, the warhead 10 would be advantageous any time increased blast or pressure wave effects, including air blast effects in air, are desired over fragmentation effects. Air blast effects typically occur over a smaller area than fragmentation effects, and are particularly effective in confined spaces.

In summary, the present invention provides an explosive device 10 that includes a housing 12 and an explosive charge within the housing 12. The explosive charge includes a primary explosive charge 20 and a shaped charge 22 placed against an inside surface of the housing 12. The explosive device may further include a buffering material that separates the shaped charge 22 and the primary explosive charge 20. The shaped charge 22 provides a means for opening the housing 12 before detonating the primary explosive charge 20, thereby enhancing the blast effect from detonating the primary explosive charge 20.

The present invention further provides a method that includes the following steps: (1) providing a penetrating warhead 10 having a primary explosive charge 20 within a casing 12 and a shaped explosive charge 22 adjacent an inside surface of the casing 12, (2) detonating the shaped explosive charge 22 to fracture the casing 12 adjacent the shaped explosive charge 22, and (3) detonating the primary explosive charge 20. The method may further include the step of detonating the primary explosive charge 20, which occurs after the step of detonating the shaped explosive charge 22.

Alternatively, the present invention can be characterized as providing a penetrating warhead 10 having a volume containing an explosive charge 20, means for protecting the explosive charge 20, means for at least partially withdrawing the protecting means, and means for initiating the withdrawing means and detonating the explosive charge 20.

The warhead 10 can further include means for separating the withdrawing means and the explosive charge 20. An exemplary separating means includes a buffering material. The protecting means can include a casing 12 having sufficient strength to withstand impact, the explosive charge being contained within the casing 12; and the withdrawing means includes a shaped explosive charge 22 adjacent an inner surface of the casing 12 to rupture the casing 12 before the explosive charge 20 is detonated.

Although the invention has been shown and described with respect to a certain illustrated embodiment, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the illustrated embodiment of the invention.

We claim:

1. An explosive warhead, comprising:

a cylindrical housing having side walls that define a cylindrical volume and bound an explosive charge within the housing, the explosive charge including a primary explosive charge, and a shaped charge placed against an inside surface of the side walls of the housing and circumferentially around the primary explosive charge, where the primary explosive charge substantially fills the cylindrical volume of the housing and the shaped charge is arranged such that detonation of the shaped charge is directed to the housing to expose the primary explosive charge without causing detonation of the primary explosive charge.

2. An explosive warhead as set forth in claim 1, further comprising a buffering material separating the shaped charge and the primary explosive charge.

3. A method, comprising the following steps: providing a penetrating warhead having a primary explosive charge within a cylindrical casing having side walls, and a shaped explosive charge adjacent an inside surface of the side walls of the casing and circumferentially around the primary explosive charge; detonating the shaped explosive charge to fracture the casing adjacent the shaped explosive charge and to expose the primary explosive charge without detonating the primary explosive charge; and detonating the primary explosive charge, where the step of detonating the primary explosive charge occurs after the step of detonating the shaped explosive charge.

4. An explosive warhead as set forth in claim 1, where the shaped charge includes a linear shaped charge that extends longitudinally from a forward end of the housing toward an aft end of the housing.

5. An explosive warhead as set forth in claim 4, comprising multiple, circumferentially-spaced linear shaped charges.

6. An explosive warhead as set forth in claim 1, where the housing includes a forward end designed to withstand impact.

* * * * *